US005628587A

United States Patent [19]

Lesslie

[11] Patent Number: 5,628,587

[45] Date of Patent: May 13, 1997

[54] BEARER PLATE

[75] Inventor: John G. Lesslie, St. Marys, Australia

[73] Assignee: Tru-Di Tool Manufacturing Co., Pty. Ltd., New South Wales, Australia

[21] Appl. No.: 510,408

[22] Filed: Aug. 2, 1995

[30] Foreign Application Priority Data

Aug. 2, 1994 [AU] Australia ..... PM7221

[51] Int. Cl.[6] ..... E02D 3/12; E21D 19/00; E21F 17/00

[52] U.S. Cl. ..... 405/302.1; 405/259.1; 405/259.6; 411/531; 411/545

[58] Field of Search ..... 405/302.1, 259.1–259.6, 405/288; 411/545, 531

[56] References Cited

U.S. PATENT DOCUMENTS

| | | | |
|---|---|---|---|
| 2,957,663 | 10/1960 | Marshall et al. | 411/531 X |
| 3,464,308 | 9/1969 | Dohmeier | 405/302.1 X |
| 4,112,693 | 9/1978 | Collin et al. | 405/132 |
| 4,371,293 | 2/1983 | Wilcox et al. | 405/302.1 |
| 4,445,808 | 5/1984 | Arya | 405/302.1 |
| 4,520,606 | 6/1985 | Francovitch | 411/531 X |
| 4,652,178 | 3/1987 | Kates et al. | 405/302.1 |
| 5,139,379 | 8/1992 | Hasan et al. | 411/531 X |

FOREIGN PATENT DOCUMENTS

| | | | |
|---|---|---|---|
| 61051 | 8/1980 | Australia . | |
| 20984 | 8/1992 | Australia . | |
| 7415863 | 6/1976 | Netherlands | 411/545 |
| 1383379 | 2/1975 | United Kingdom . | |

*Primary Examiner*—Dennis L. Taylor
*Attorney, Agent, or Firm*—Leydig, Voit & Mayer

[57] ABSTRACT

A bearer plate for use with rock bolts or friction rock stabilisers has a plate with an earth engaging surface and an aperture. A wall circumscribes the aperture and extends generally away from the plane of the plate. The wall includes a plurality of spaced apart rib formations that extend in a generally radial direction from the aperture. The direction of indentation of the ribs into the wall is opposite to the expected direction of deformation of the wall when subjected to a compressive load applied in the axial direction of the aperture.

26 Claims, 10 Drawing Sheets

BEARER PLATE

BACKGROUND OF THE INVENTION

The present invention relates to a bearer plate for use with rock bolts or friction rock stabilisers and in particular to a bearer plate having an increased compression resistance for a given material thickness.

Bearer plates, also commonly known as face plates or rock plates, are used with various types of rock bolts or friction rock stabilisers, to bind together rock strata to stabilise the rock formation and inhibit its collapse. The bearer plates act to distribute the load applied by the bolt. The bolts and bearer plates in combination have application in mines, rock cuttings, tunnels and any other excavations where stabilisation of the rock strata is required.

Whilst a wide variety of different bearer plates are available, it has previously been necessary to use relatively heavy gauge materials to achieve the load ratings required. This adds not only to the material cost, but also to the production cost in terms of the cost of tooling and press capacity required to make the plates.

SUMMARY OF THE INVENTION

It is an object of the present invention to provide a bearer plate of increased compression strength for a given material thickness.

According to the invention there is provided a bearer plate for use with a rock bolt or the like, said bearer plate comprising:

a plate formed of rigid sheet material, said plate having a first outer peripheral substantially uni-planar earth engaging portion, and a second inner substantially centrally located portion including an aperture wherein having an axis extending substantially transverse to the planar extent of the earth engaging surface portion;

said second portion including a wall surface that circumscribes said aperture and extends generally outwardly away from the plane of the first surface, said wall surface including a plurality of spaced apart indented rib formations that each extend in a generally radial direction from the aperture, the direction of indentation of said ribs into the wall surface being opposite to the expected direction of deformation of the wall surface when subjected to a compressive load applied in the direction of the axis of the aperture.

In a preferred embodiment, the wall surface extends generally outwardly away from the earth engaging portion and generally radially inwardly toward the axis of the aperture, preferably at a substantially constant predetermined angle and the rib formations are indented substantially radially inwardly towards the axis of the aperture.

Preferably, the wall extends from the first surface to define a generally frusto conical surface that terminates at its edge remote from the to define an annular bearing surface for engagement with a rock bolt or the like.

In a preferred form, the rim of the aperture comprises an inturned portion of said material, said inturned portion defining said annular bearing surface.

In an embodiment the inturned portion terminates in a substantially cylindrical wall portion extending generally normally to the plane of the earth engaging portion.

In another embodiment the periphery of said inturned portion is further inturned into abutment with an inner surface of the wall.

In another preferred form, the bearer plate is welded to a butterfly plate which further distributes the load and helps protect against spalling.

BRIEF DESCRIPTION OF THE DRAWINGS

A number of preferred embodiments of the invention will now be described, by way of example only, with reference to the accompanying drawings in which.

DESCRIPTION OF PREFERRED EMBODIMENTS

Figure 1:
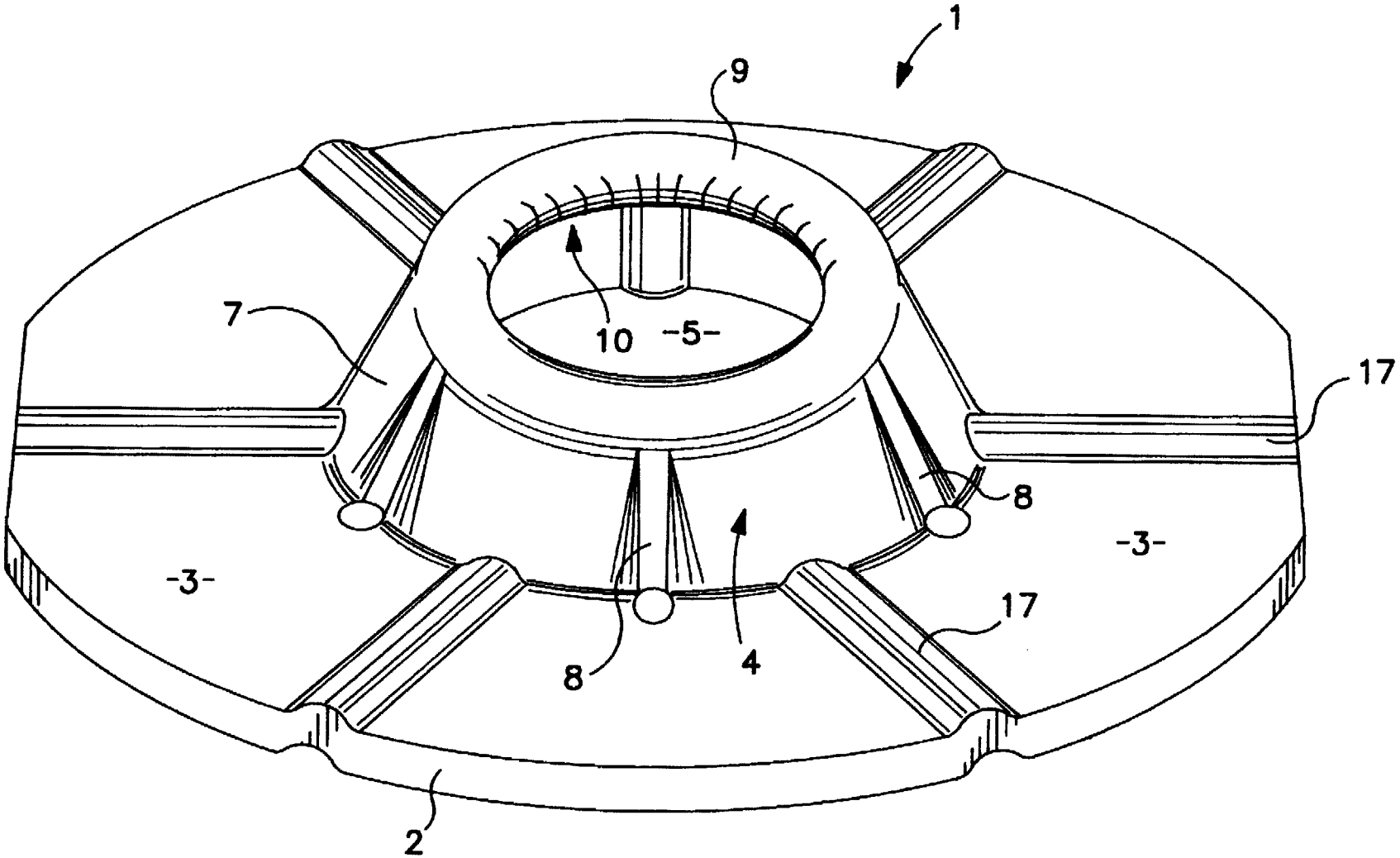
FIG. 1 is a perspective view of a first embodiment of a bearer plate according to the invention.
Figure 2:
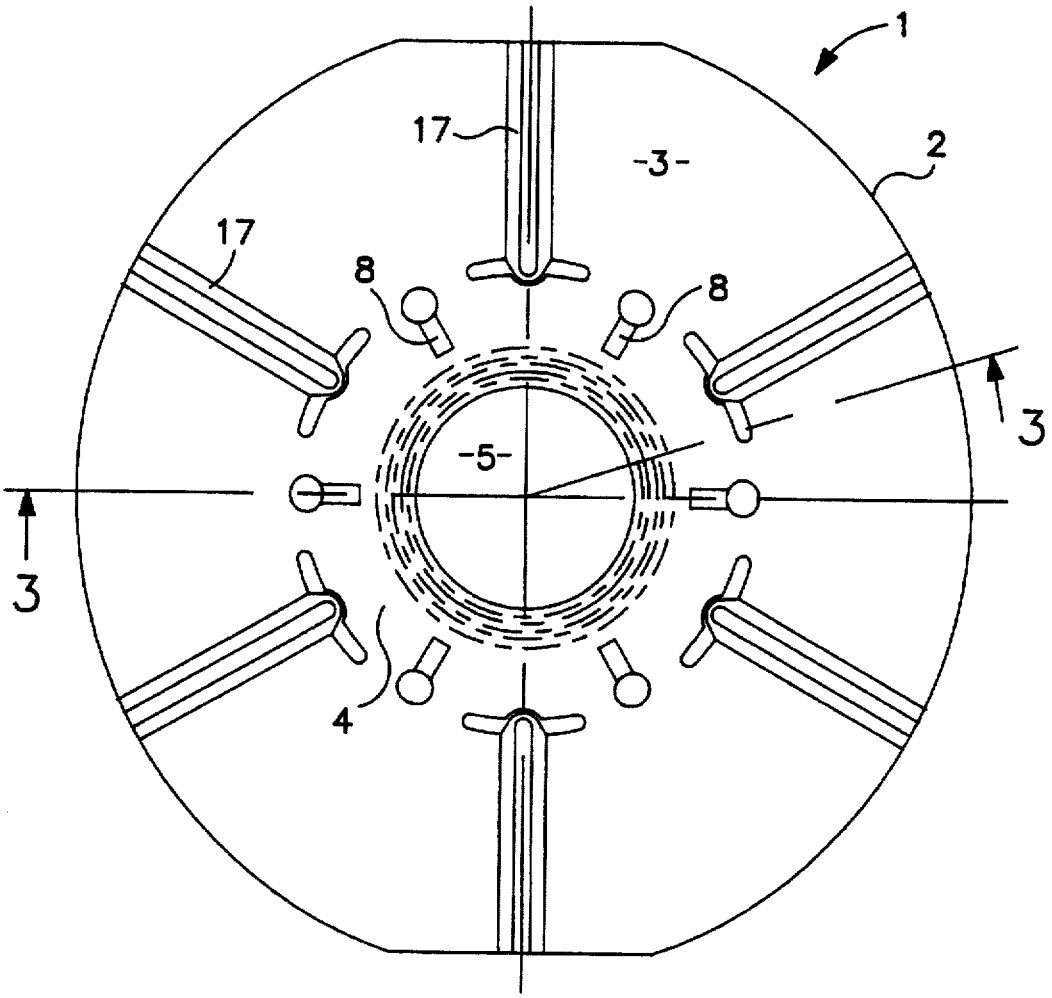
FIG. 2 is a plan view of the bearer plate shown in FIG. 1.
Figure 3:
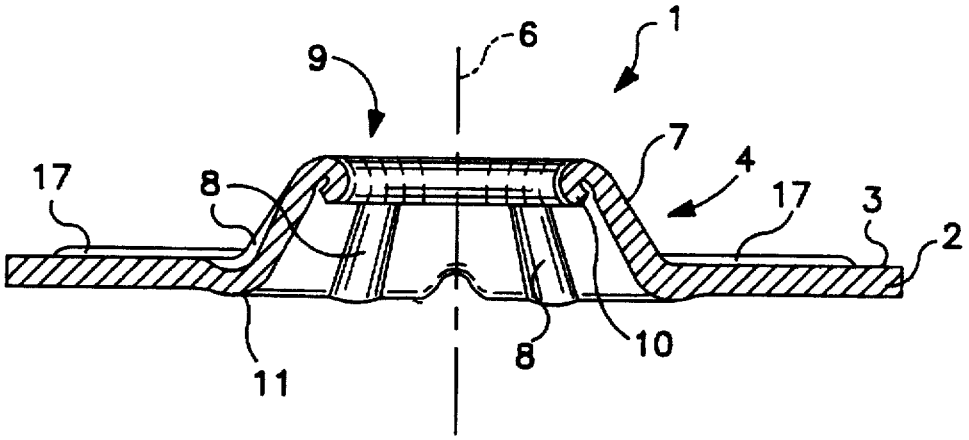
FIG. 3 is a sectional view of a bearer plate taken along line 3—3 of FIG. 2.
Figure 4:
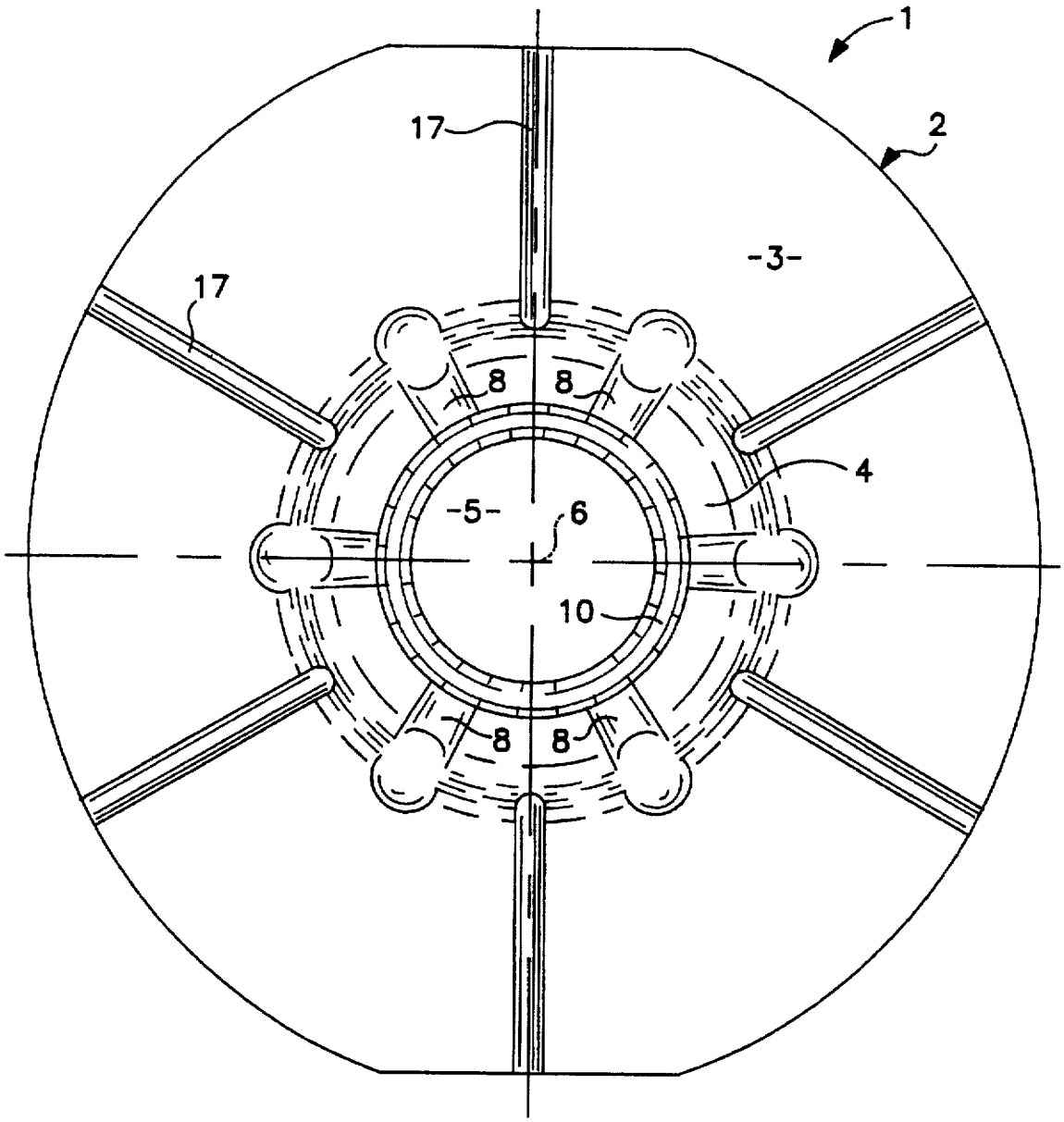
FIG. 4 is an inverted plan view of the bearer plate shown in FIGS. 1 to 3.
Figure 5:
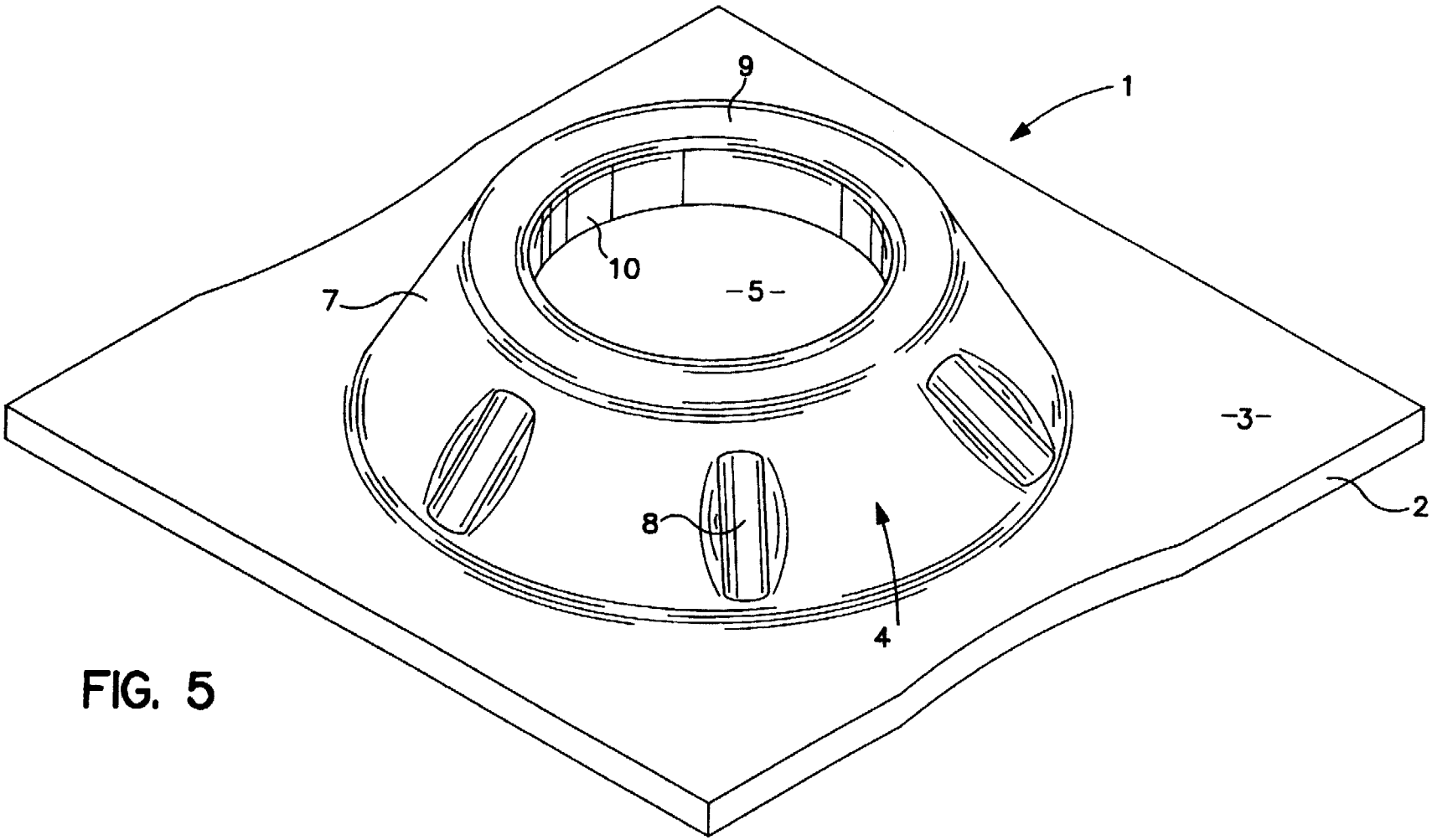
FIG. 5 is a perspective view of a second embodiment of a bearer plate according to the invention.
Figure 6:
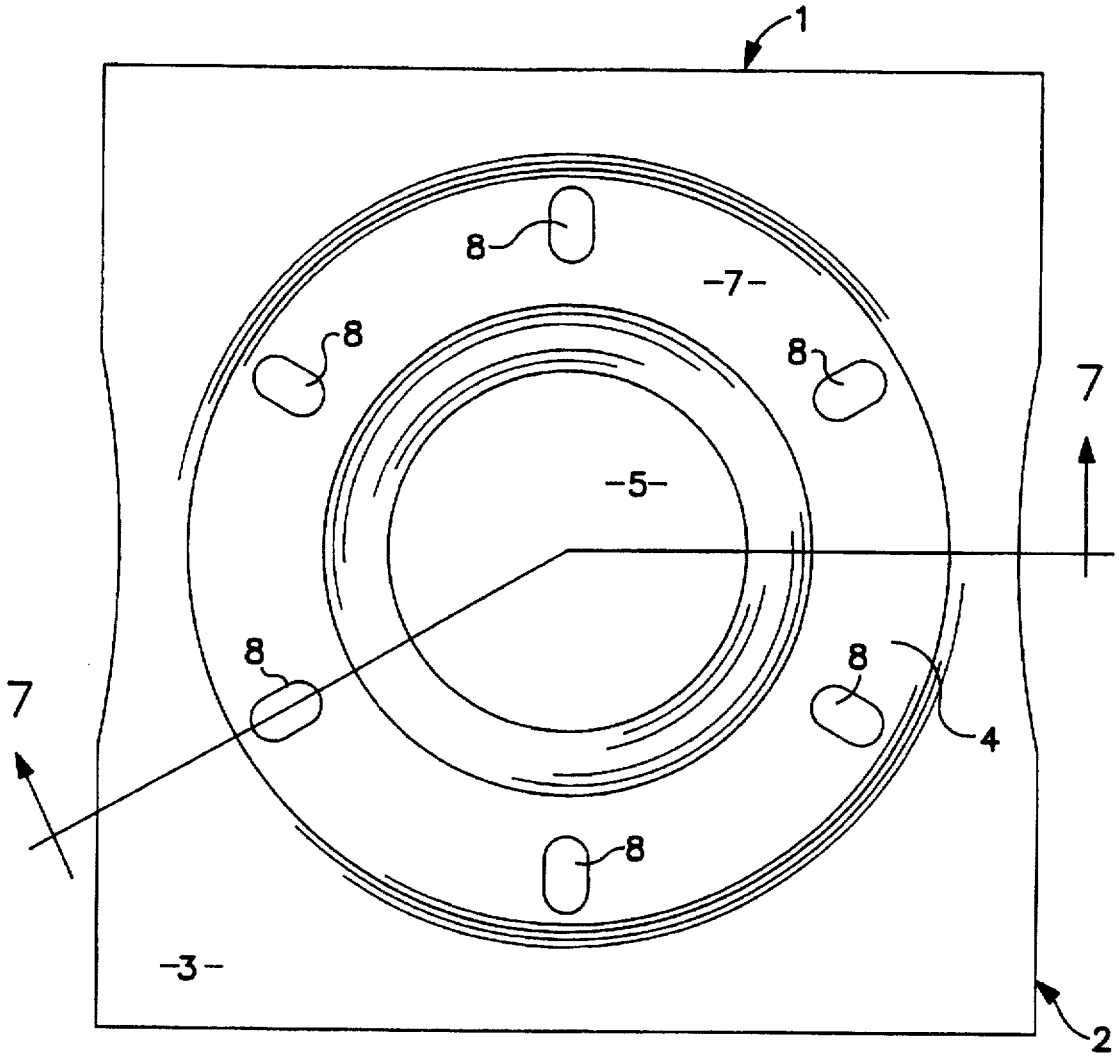
FIG. 6 is a plan view of the bearer plate shown in FIG. 5.

Referring to FIGS. 1 to 4, there is shown a first embodiment of a bearer plate according to the invention. The bearer plate 1 comprises a plate shown generally at 2 formed of a rigid sheet material. The plate 2 has a first outer peripheral substantially uni-planar earth engaging portion 3 and a second inner substantially centrally located portion 4 in which is formed an aperture 5. The aperture has an axis 6 which extends substantially transverse to the planar extent of the earth engaging portion 3.

The second portion 4 includes a wall 7 that circumscribes the aperture 5 and which extends generally outwardly away from the plane of the earth engaging portion.

The wall 7 also includes a plurality of spaced apart indented rib formations 8 that extend in a generally radial direction from the aperture 5, the direction of indentation of the ribs into the wall 7 being opposite to the expected direction of deformation of the wall when it is subjected to a compressive load applied in the direction of the axis of the aperture.

In the preferred form shown, the wall extends from the earth engaging portion to define a generally frusto-conical surface that is preferably inclined at an angle of approximately 110° to 120° to the plane of the earth engaging portion.

The frusto-conical surface terminates at its edge remote the earth engaging portion 3 in an annular bearing surface, shown generally at 9, for engagement with a rock bolt or the like. The rim of the aperture 5 comprises an inturned portion 10 which defines the bearing surface 9. In the embodiment shown, the inturned portion 10 is further inturned into abutment with an inner surface of the wall.

In this first embodiment, the plates each have six equi-angularly spaced rib formations 8 which extend from a position adjacent the bearing surface 9, terminating in a run-out portion 11 that extends substantially tangentially with the earth engaging portion 3. The outer peripheral earth-engaging portion 3 also includes six equi-angularly spaced strengthening ribs 17 of generally U-shaped cross-section angularly intermediate adjacent rib formations 8. The ribs 17 extend radially from the outer periphery of the second portion to the outer periphery of the earth engaging portion.

The abutment of the inturned portion 10 with the inner surface of wall 7 provides additional advantages to the bearer plate according to the invention over existing plates.

One of these advantages is that the inturned bearer plate wall is stronger than planar walls of similar dimensions and materials.

Another advantage is that the bearer plate has no external sharp edges and thus is safer to handle and results in less operator injury than existing planes.

The bearer plate 1 may be made from a low grade steel. The preferred steel grades are: HA250; XF400: and XF500. The plates are currently produced in a variety of thicknesses ranging from 2 mm to 6 mm and move preferably from 3 mm to 5 mm. Plate sizes currently envisaged include: round plates of 100 mm to 200 mm diameter; and square plates having an edge length of 120 mm to 150 mm. Preferred hole sizes are in the range of 18 mm no 59 mm. The conical boss section is scaled approximately proportionally for each hole size.

In all embodiments shown, the frusto-conical wall 7 extends approximately 20 mm from the upper surface of the earth engaging portion 3 and converges from an external diameter at the upper surface of the plate of approximately 90 mm, to define an aperture opening of approximately 45 mm diameter.

FIGS. 5 to 8 show a second embodiment of a bearer plate similar to the first embodiment but having a square surface 3 without the strengthening ribs 17. Like numerals are used to denote corresponding features in this second embodiment.

Figure 7:
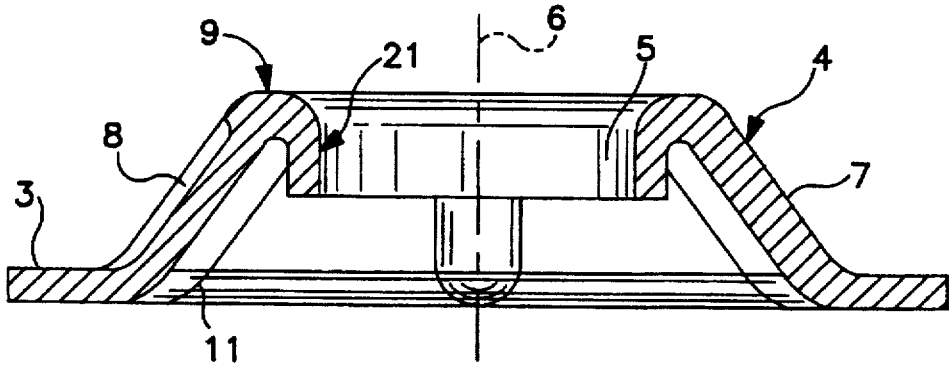
FIG. 7 is a sectional view of a bearer plate taken along line 7—7 of FIG. 6.
Figure 8:
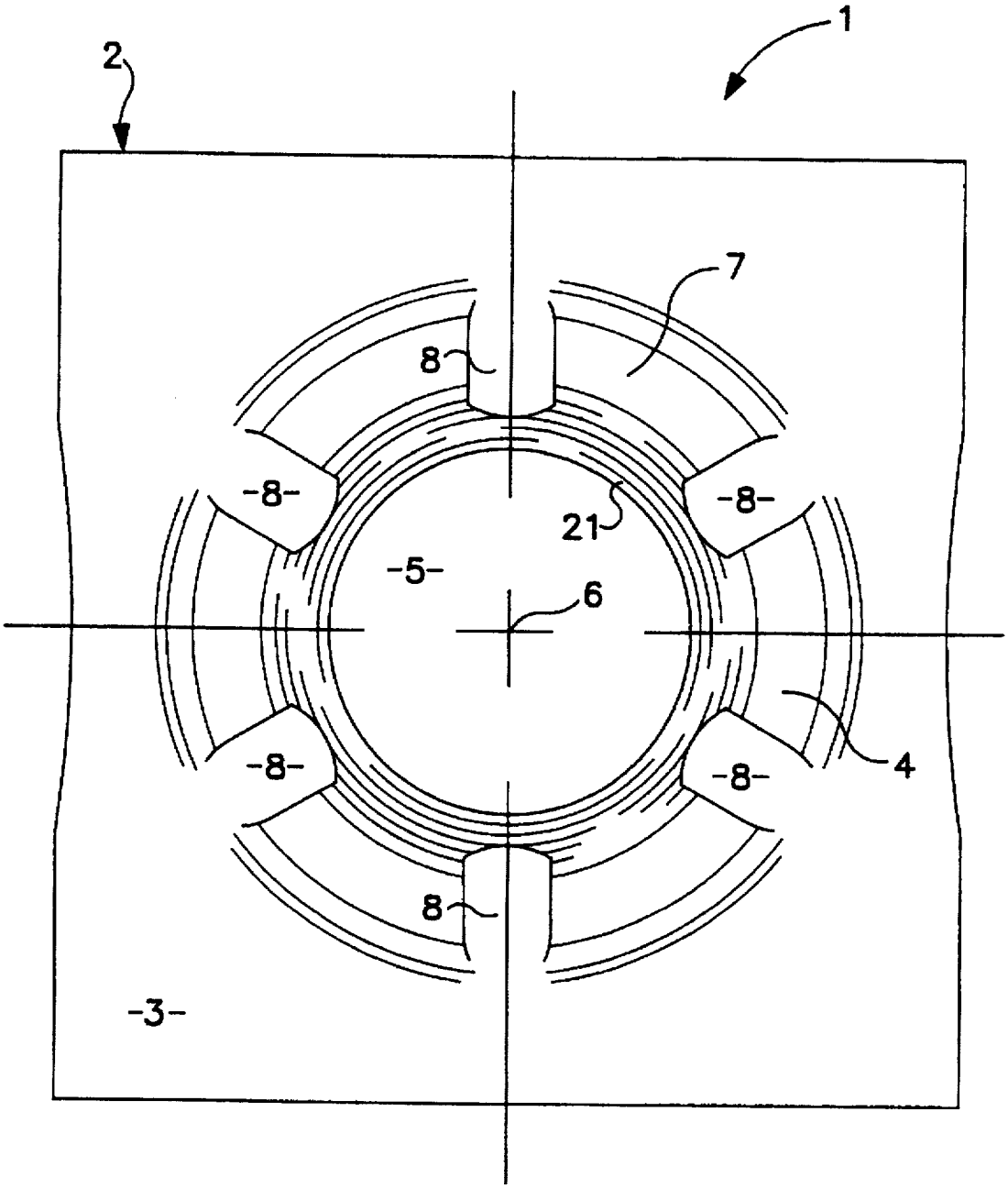
FIG. 8 is an inverted plan view of the bearer plate shown in FIGS. 5 to 7.
Figure 9:
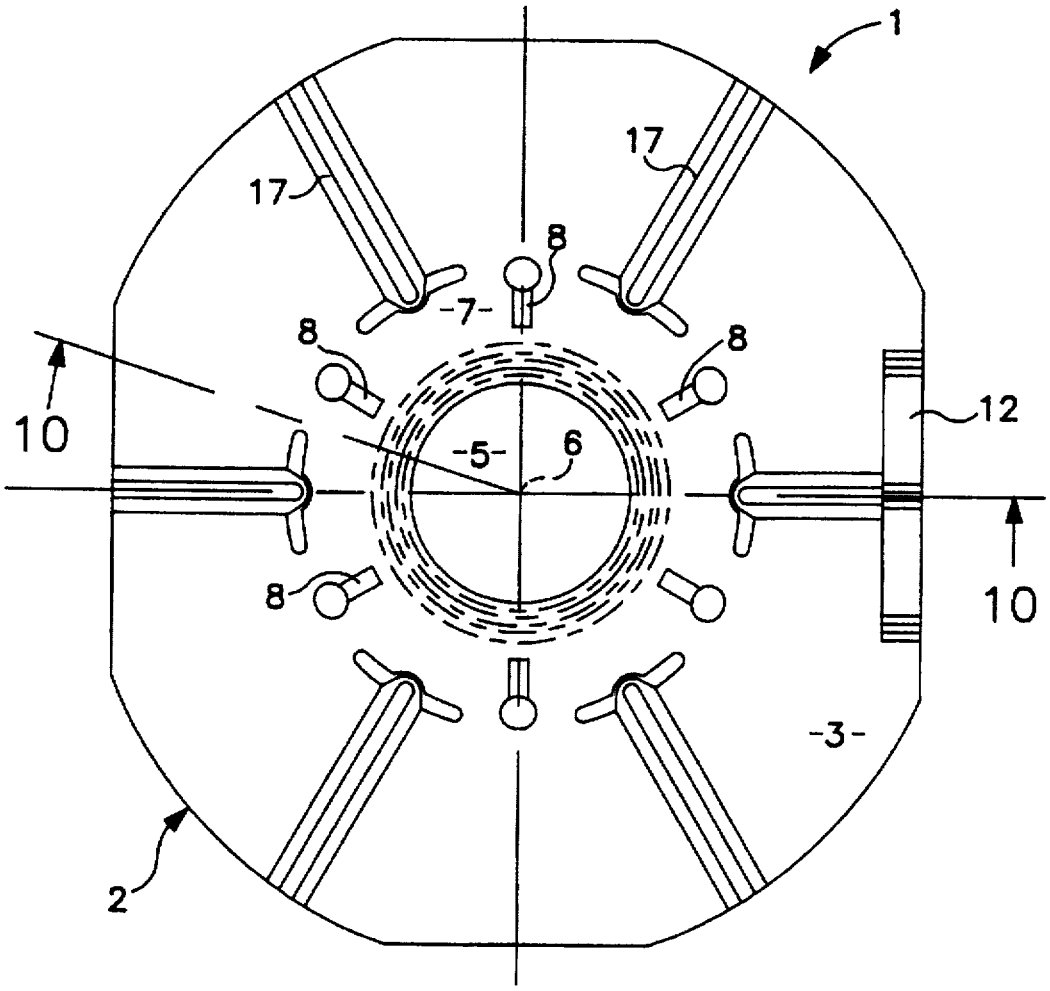
FIG. 9 is a plan view of a third embodiment of a bearer plate according to the invention incorporating a service loop.
Figure 10:
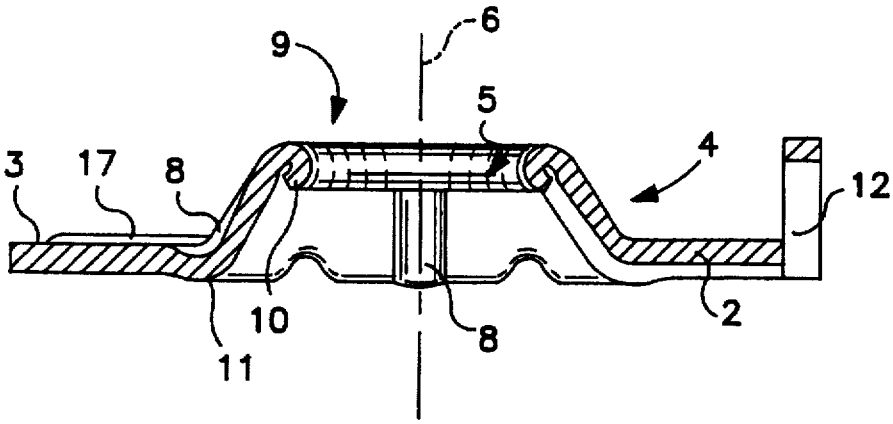
FIG. 10 is a sectional view of the bearer plate taken along line 10—10 of FIG. 9.
Figure 11:
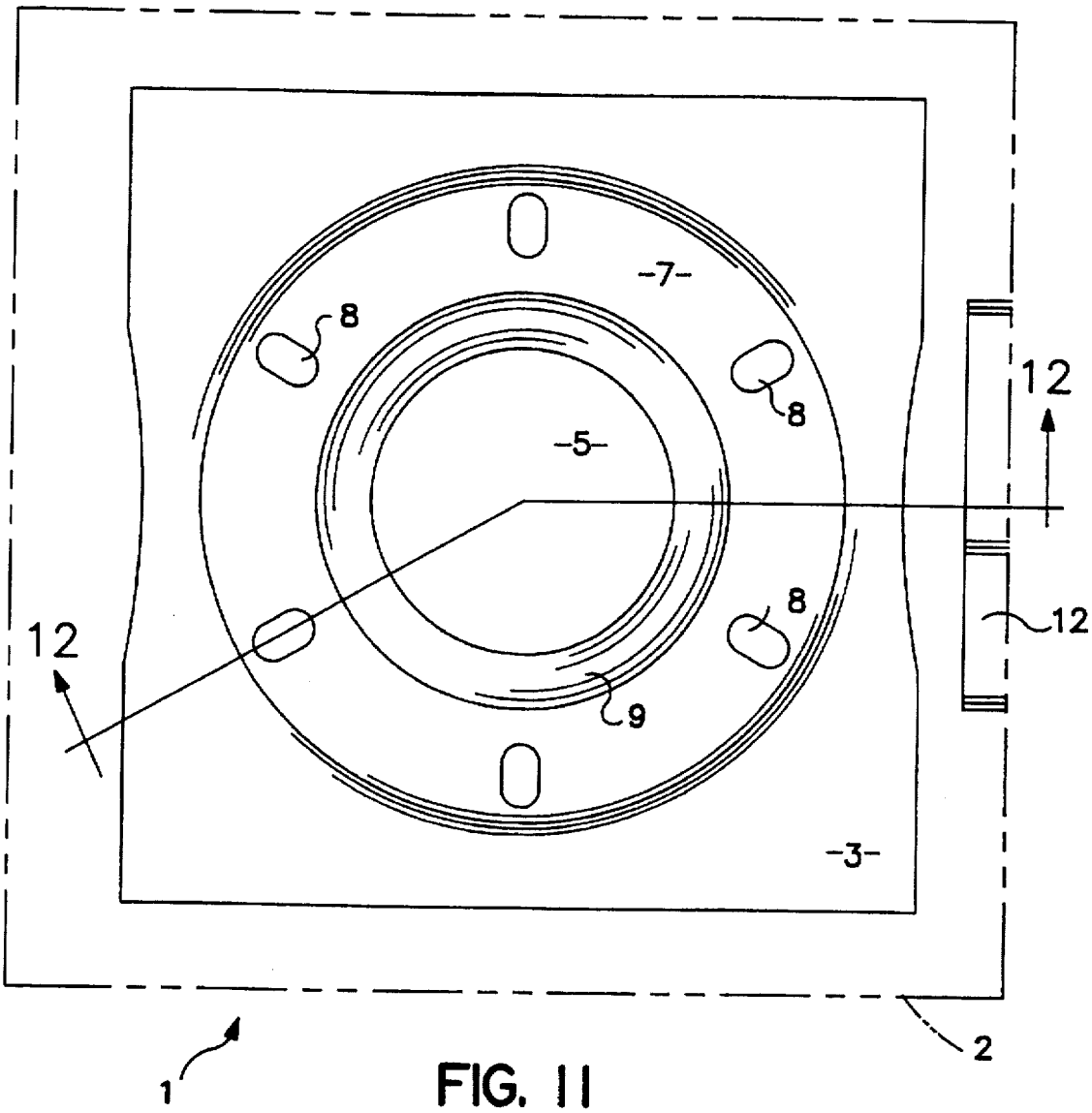
FIG. 11 is a plan view of a fourth embodiment of a bearer plate according to the invention incorporating a service loop.
Figure 12:
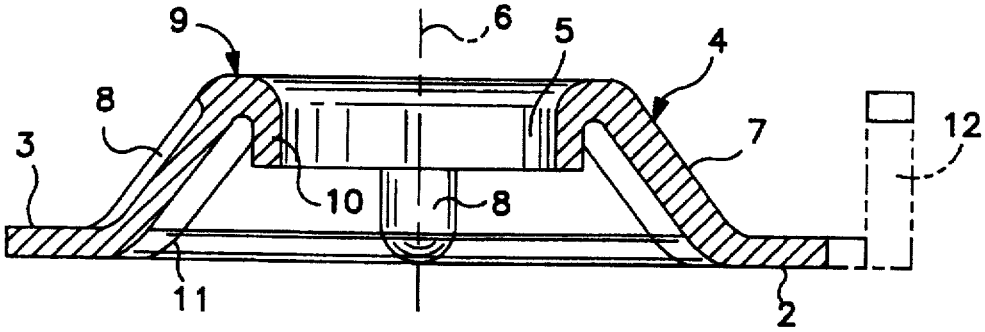
FIG. 12 is a sectional view of the bearer plate taken along line 12—12 of FIG. 11.
Figure 13:
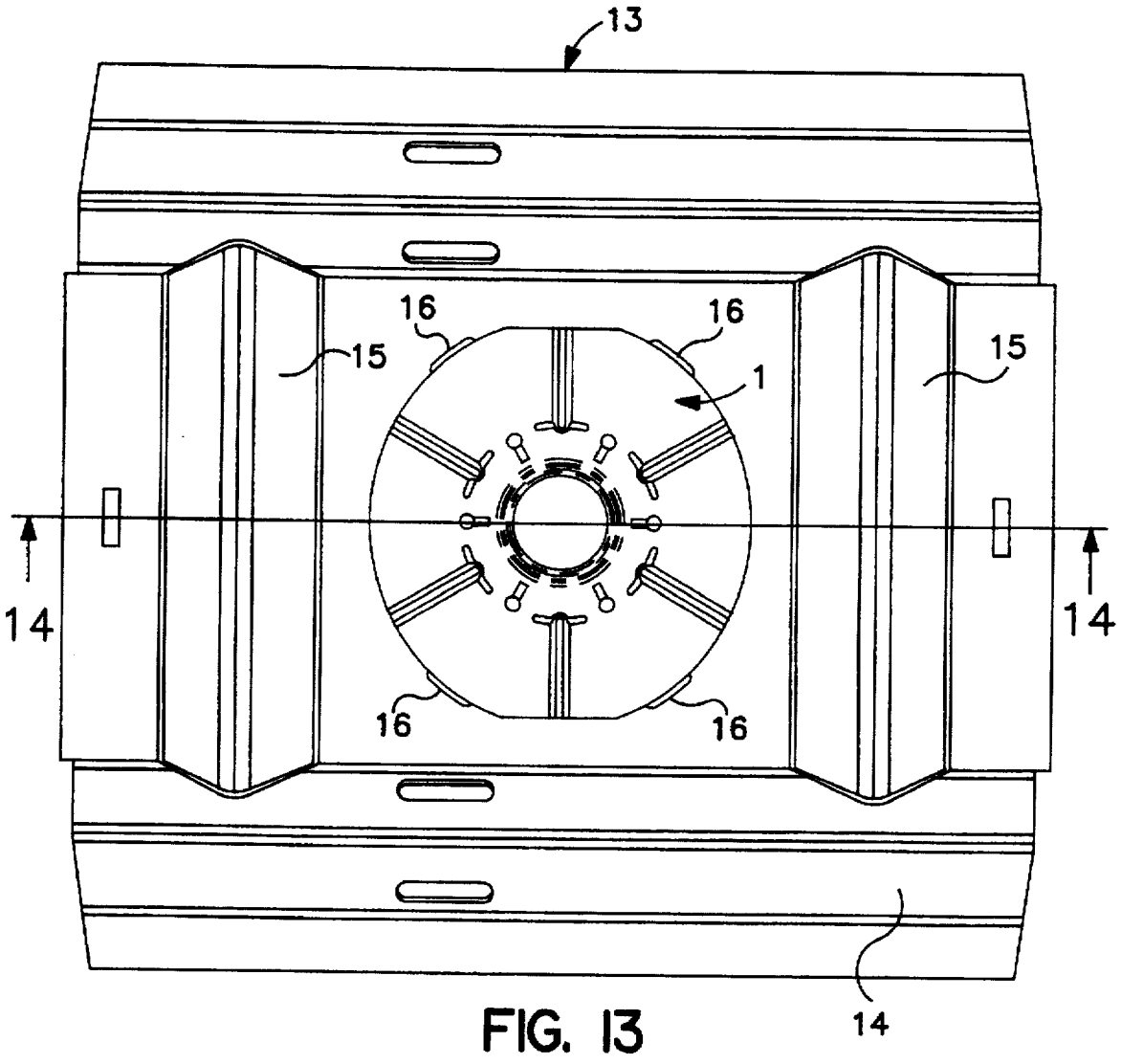
FIG. 13 is a plan view of a bearer plate according to the first embodiment of the invention welded to a butterfly plate.
Figure 14:
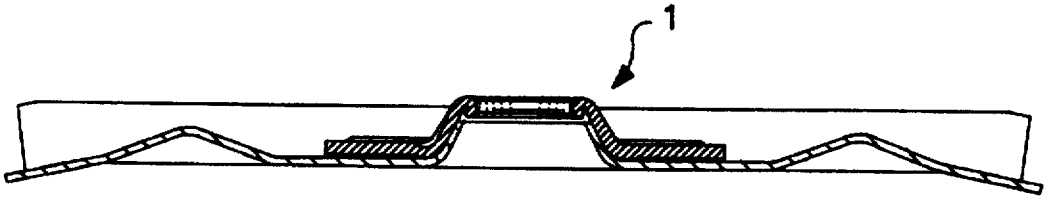
FIG. 14 is a sectional view of the bearer plate taken along line 14–14 of FIG. 13.
Figure 15:
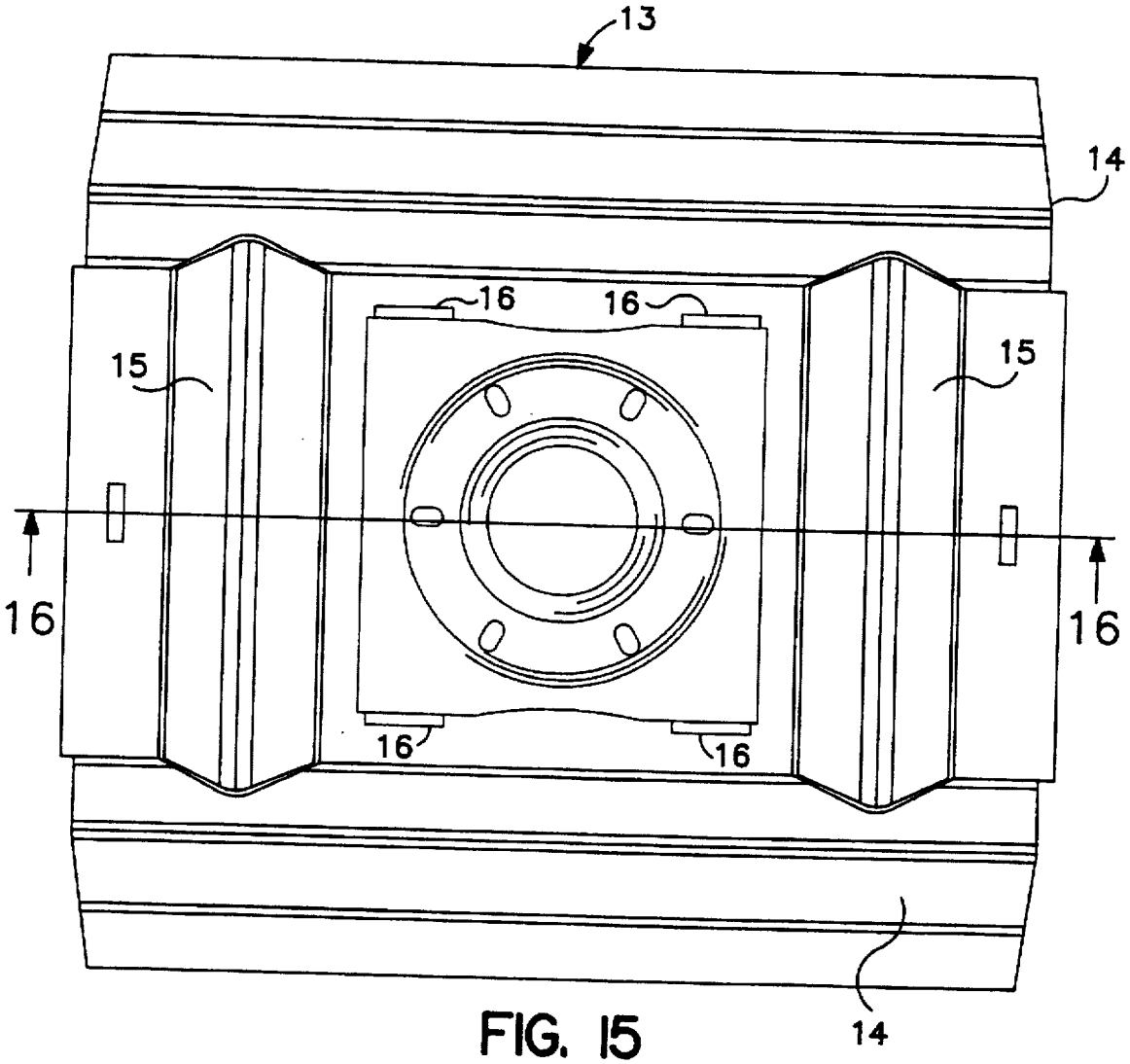
FIG. 15 is a plan view of a bearer plate according to the second embodiment of the invention welded to a butterfly plate.
Figure 16:
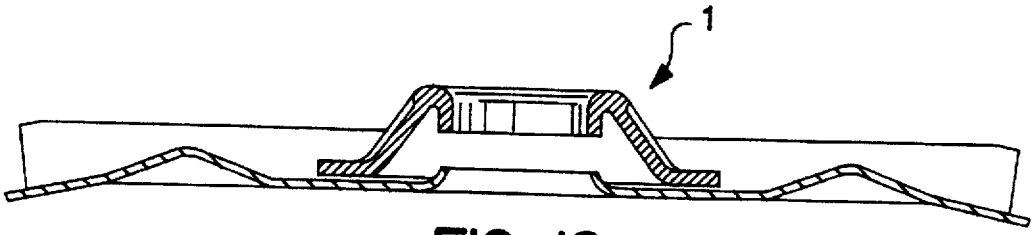
FIG. 16 is a sectional side view of the bearer plate taken along line 16—16 of FIG. 15.

As best shown in FIG. 7, in this second embodiment the inturned portion 10 terminates in a cylindrical wall portion 21 extending generally normally to the plane of the first surface 3.

Referring to FIGS. 9, 10 and 11, 12 there is respectively shown third and fourth embodiments of bearer plates according to the invention. The main features are essentially the same as the first and second embodiments and like reference numerals have been used to denote corresponding features.

The main difference in these third and fourth embodiments from the embodiments discussed previously is that the overall plate size is larger and includes a service loop 12 through which cabling and hoses can be secured to the supported surface. The loop is formed by shearing a slit adjacent the end of the plate and pressing out the edge to form a loop.

In all embodiments, the bearer plate complete with rib formations is produced in a multi-stage progressive die in the manner well-known to those skilled in the art.

Turning to FIGS. 13, 14 and 15, 16 there are shown two similar preferred applications of the bearer plane 1 according to previous embodiments of the invention in which the bearer plate is pre-welded to a butterfly plate 13. The butterfly plate illustrated in these Figures two parallel transversely extending reinforcing ribs 14 joined by two interconnecting ribs 15 that extend transversely to the ribs 14. The bearer plate 1 is welded peripherally at 16. The resulting structure combines the advantages of both elements and further reduces the number of stock items to be handled. The operation of fitting the plates is also made faster as one unit replaces two items that were previously handled separately. Furthermore, operator error resulting in incorrect matching of the parts is substantially eliminated.

The bearer plate according to the invention achieves a higher resistance to compression loading than the majority of currently available prior art plates. In the embodiments described, the expected mode of deformation of the frusto-conical wall section is to deform radially outwardly away from the axis of the aperture.

The raised frusto-conical section is also of a more vertical shape than most other "domed style" products on the market, which not only gives the bearer plate more resistance to deformation, it increases the flat bearing surface available in the base of the plate. By indenting the vertically extending ribs inwardly toward the axis and increasing the inclination of the wall surface, it has been possible to increase the compression loading by up to the order of The plates have been tested to industry standards and have achieved significantly higher tonnages for materials which are thinner than other plates in the market place. This has resulted in the ability supply a plate which is more versatile in this application and at a substantially reduced cost to operators.

Although the invention has been described with reference to a specific embodiment, it will be clear to those skilled in the art, that the invention may be embodied in many other forms.

I claim:

1. A bearer plate for use with a rock bolt or the like, said bearer plate comprising:

a plate formed of rigid sheet material, said plate having a first outer peripheral substantially uni-planar earth engaging portion, and a second inner substantially centrally located portion including an aperture therein having an axis extending substantially transverse to the planar extent of the first portion;

said second portion including a wall that circumscribes said aperture and extends generally outwardly away from the plane of the first portion, said wall including a plurality of spaced apart rib formations indented towards an axis of the aperture that each extend in a generally radial direction from the aperture.

2. A bearer plate as claimed in claim 1 wherein the wall extends generally outwardly away from the first portion and generally radially inwardly toward the axis of the aperture.

3. A bearer plate as claimed in claim 2 wherein said wall extends generally outwardly away from the first portion and generally radially inwardly towards the axis of the aperture at a substantially constant predetermined angle.

4. A bearer plate as claimed in claim 3 wherein said predetermined angle is between approximately 110° and 20°.

5. A bearer plate as claimed in claim 1 wherein the wall extends from the first portion to define a generally frusto conical surface that terminates at its edge remote from the first portion to define an annular bearing surface for engagement with a rock bolt or the like.

6. A bearer plate as claimed in claim 5 wherein the rim of the aperture comprises an inturned portion of said material, said inturned portion defining said annular bearing surface.

7. A bearer plate as claimed in claim 6 wherein said inturned portion terminates in a substantially cylindrical wall portion extending generally normally to the plane of the first portion.

8. A bearer plate as claimed in claim 6 wherein the periphery of said inturned portion is further inturned into abutment with an inner surface of the wall.

9. A bearer plate as claimed in claim 1 wherein said bearer plate includes six of said indented rib formations equiangularly spaced on the wall.

10. A bearer plate as claimed in claim 1 wherein said first portion includes a plurality of generally U-shaped cross-section strengthening ribs extending radially from the outer periphery of the second portion to the outer periphery of the first portion.

11. A bearer plate as claimed in claim 10 wherein said bearer plate includes six Of said strengthening ribs equiangularly spaced with respect to each other.

12. A bearer plate as claimed in claim 10 including six of said strengthening ribs on said first portion and six of said indented rib formations on said wall disposed angularly intermediate said strengthening ribs.

13. A bearer plate as claimed in claim 1 wherein said plate includes a service loop through which cabling, hoses and the like can be secured.

14. A bearer plate as claimed in claim 13 wherein said service loop extends normally from the first portion at or adjacent the periphery thereof.

15. A bearer plate as claimed in claim 14 wherein said service loop is formed by shearing a slit adjacent the periphery of the plate and pressing the slit normally outwardly from the first portion to form a loop.

16. A bearer plate as claimed in claim 1 wherein said bearer plate is formed from steel plates having a thickness between approximately 2 mm and 6 mm.

17. A bearer plate as claimed in claim 16 wherein said thickness is between approximately 3 mm and 5 mm.

18. A bearer plate as claimed in claim 1 wherein said first portion has a diameter approximately ranging from 100 mm to 200 mm.

19. A bearer plate as claimed in claim 1 wherein said first portion is substantially square shaped and has an edge length approximately ranging from 120 mm to 150 mm.

20. A bearer plate as claimed in claim 1 wherein said aperture internal diameter is approximately between 18 mm and 59 mm.

21. A bearer plate as claimed in claim 1 wherein said bearer plate is formed from a material selected from HA250, XF400, and XF500 grade steel.

22. A bearer plate as claimed in claim 1 wherein the bearer place is welded to a butterfly plate.

23. A bearer plate as claimed in claim 22 wherein the periphery of said bearer plate is welded to said butterfly plate.

24. A bearer place as claimed in claim 22 wherein said butterfly plate includes two parallel transversely extending reinforcing ribs joined by two interconnecting ribs extending transversely to said reinforcing ribs.

25. A bearer plate as claimed in claim 1 wherein the first portion has a first side for contacting a surface to be supported by the bearer plate and a second side opposite to the first side, the wall extending from the second side away from the surface to be supported.

26. A bearer plate for supporting a rock formation comprising:

a plate formed of rigid sheet material and having a substantially planar earth engaging portion with a first side for contacting a rock formation and a second side facing in an opposite direction from the first side, and a substantially frustoconical wall extending outwardly from the second side of the earth engaging portion and surrounding an aperture for receiving a rock bolt for engagement with a rock formation contacted by the first side, the aperture having an axis extending substantially perpendicular to a plane of the earth engaging portion, the wall having an outer edge remote from the earth engaging portion forming a bearing surface for a head of a rock bolt, the wall including a plurality of spaced apart rib formations each indented towards the axis of the aperture and extending in a generally radial direction with respect to the axis of the aperture.

* * * * *

UNITED STATES PATENT AND TRADEMARK OFFICE

CERTIFICATE OF CORRECTION

PATENT NO. : 5,628,587

DATED : May 13, 1997

INVENTOR(S) : Lesslie

It is certified that error appears in the above-indentified patent and that said Letters Patent is hereby corrected as shown below:

Column 4, Line 67, change "20°" to --120°--;

Column 5, Line 25, change "Of" to --of--.

Signed and Sealed this

Sixteenth Day of September, 1997

*Attest:*

Bruce Lehman

BRUCE LEHMAN

*Attesting Officer*

*Commissioner of Patents and Trademarks*